United States Patent [19]

Tolan

[11] Patent Number: 4,880,147

[45] Date of Patent: Nov. 14, 1989

[54] AIR BLAST GENERATOR

[76] Inventor: Peter J. Tolan, 30 Greenfield Lane, Scituate, Mass. 02066

[21] Appl. No.: 587,204

[22] Filed: Mar. 7, 1984

[51] Int. Cl.[4] ..... B65G 53/38

[52] U.S. Cl. ..... 222/195; 222/3; 222/212; 222/339; 222/444; 406/137

[58] Field of Search ..... 222/3, 195, 207, 212, 222/95, 336, 339, 340, 386, 444; 406/137, 85; 366/101; 138/30

[56] References Cited

U.S. PATENT DOCUMENTS

| | | | |
|---|---|---|---|
| 1,932,666 | 10/1933 | Hyatt | 138/30 |
| 3,075,558 | 1/1963 | Von Forell | 138/30 |
| 3,715,062 | 2/1973 | Todd et al. | 222/340 |
| 3,788,527 | 1/1974 | Matson | 222/195 |

FOREIGN PATENT DOCUMENTS

| | | | |
|---|---|---|---|
| 2727542 | 1/1979 | Fed. Rep. of Germany | 222/195 |

*Primary Examiner*—Joseph J. Rolla
*Assistant Examiner*—Gregory L. Huson
*Attorney, Agent, or Firm*—Robert E. Ross

[57] ABSTRACT

An air blast generator is provided in the form of a pressure accumulator with a spring-loaded bellows. Air pressure expands the bellows, compressing the spring to store energy. When a valve is opened the spring aids in expulsion of the air such that a high pressure discharge of air is provided for a larger duration than would be possible without the spring.

10 Claims, 3 Drawing Sheets

AIR BLAST GENERATOR

BACKGROUND OF THE INVENTION

In the feeding of powdered, granular, flake or the like material from a supply hopper onto a conveyor or into containers, a common problem is "bridging" of the material in the hopper, whereby self-supporting arch of the material forms between opposite walls of the hopper. Many devices have been proposed for preventing or correcting such bridging, such as means for vibrating the hopper walls, pulsating devices, and internal mechanical agitators, all of which have disadvantages, since most of such devices must be built as an integral part of the hopper when it is originally manufactured, and cannot be readily applied as retrofit equipment. Devices of the vibrating type which can be attached to the outside of the hopper wall are often not effective with large hoppers because of the large mass involved, and are not effective at all with certain types of materials. Mechanical agitating devices have a high original cost and require considerable maintenance, and when the device is being repaired, the hopper is out of service.

In some cases blasts of air applied through the wall of the hopper at regular intervals has been found effective to prevent bridging, however in large hoppers or with certain types of heavy material, for such an air blast to be effective,the air pressure must be higher than can be safely used, and in situations where an air blast must be used more or less continuously, the expense of producing the compressed air can be a significant addition to the cost of the operation.

SUMMARY OF THE INVENTION

This invention provies a device for generating an air blast for feeding through the wall of a hopper or conduit or other container through which particulate material is flowing, to prevent of break up bridging or other forms of clogging of the flowing material.

A bellows is provided which is pressurized from a supply of compressed air. Expansion of the bellows compresses one or more resilient members such as springs, with stop means being provided in the housing for limiting the amount of bellows expansion, so that in the fully charged condition, full line pressure is present in the bellows, and the resilient members are compressed until the bellows reaches the stop means. When the pressure is released from the bellows to exhaust into the hopper or conduit, the force of the compressed resilient members assist in forcing the air out of the bellows, and maintains a high air exhaust velocity throughout the entire exhaust portion of the operating cycle. In a preferred embodiment of the invention, the spring rate of the resilient members is so selected that when the bellows is charged to full line pressure, the bellows bear against the stop member with only a slight force, which provides the maximum efficiency in the utilization of the compressed air.

DESCRIPTION OF THE ILLUSTRATED EMBODIMENT

Figure 1:
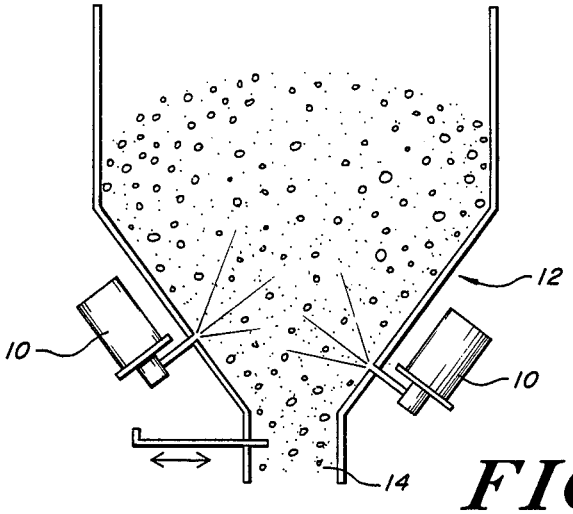
FIG. 1 is a view in side elevation, partly in section, of a material feed hopper having air blast generators as described herein mounted thereon.

Referring to the drawing, there is illustrated an air burst generator device 10, which is particularly adapted for use with a hopper 12 for containing particulate material and for feeding it out of a bottom opening 14.

The air burst generator 10 comprises a housing 16 including top and bottom plates 18 and 20 respectively. Mounted onto the top plate 18 are a group of rods 22 which extend downwardly into the housing to terminate at ends positioned at a medial position in the housing. A spring 24 is mounted on each rod 22 for a purpose to appear hereinafter.

Disposed between the lower end of the rods 22 and the lower plate 20 is a bellows member 26, which has a medial portion 28 formed of resilient material such as rubber and top and bottom support plates 30 and 32 respectively formed of metal or other rigid material.

The bottom bellows plate 32 has a threaded opening 34 for receiving a threaded pipe nipple 36 which extends through the housing bottom plate 32 for connection to an air supply for pressurizing the bellows.

Figure 4:
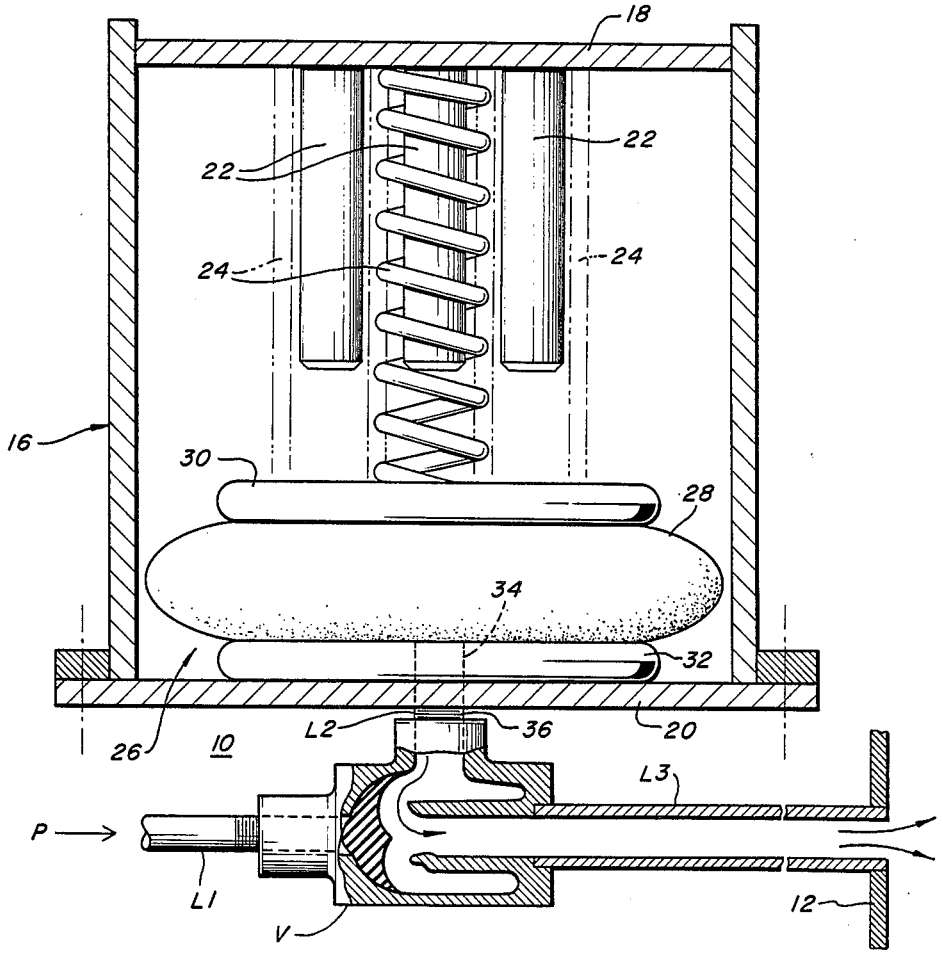
FIG. 4 is a view similar to FIG. 2, in which the bellows has been exhausted and compressed by the springs.

In the un-pressurized condition, the force of the springs against the top plate 30 of the bellows maintains the bellows in the compressed condition, as illustrated in FIG. 4.

Figure 2:
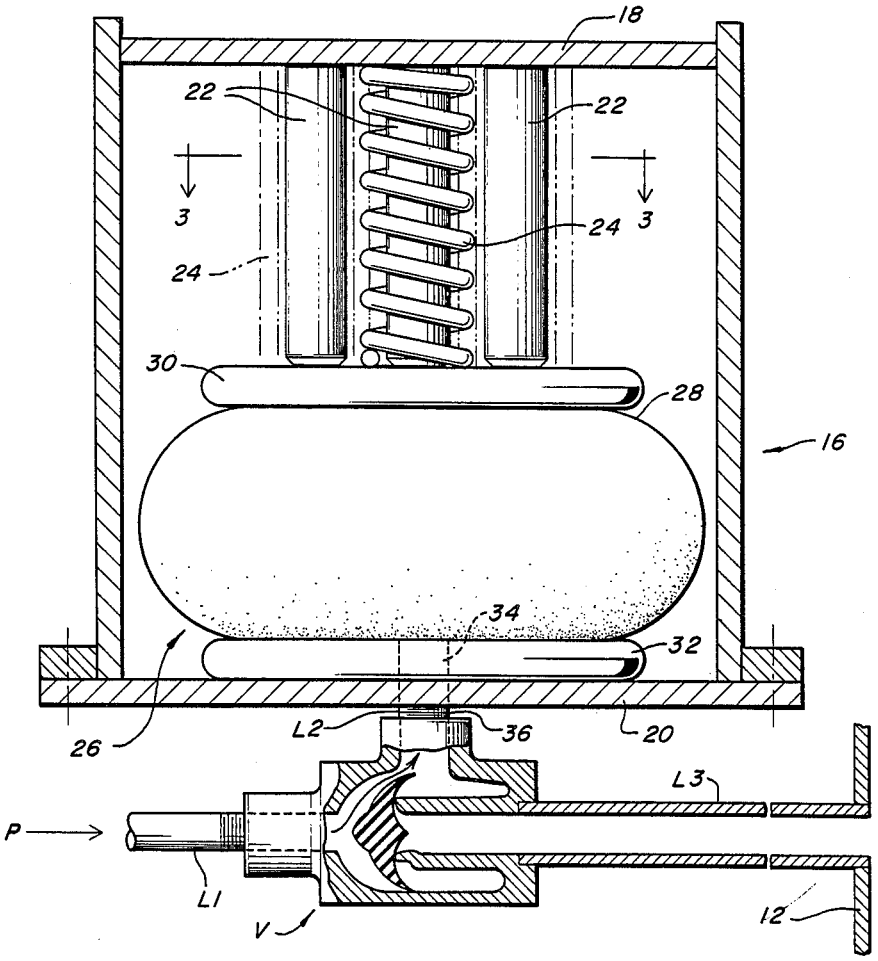
FIG. 2 is a view in side elevation, partly in section, of an air blast generator embodying the features of the invention, in which the bellows is fully charged with air.
Figure 3:
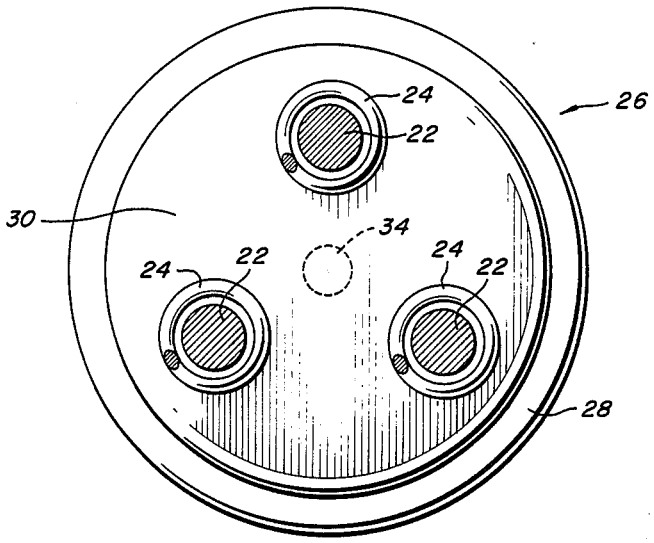
FIG. 3 is a view in section taken on line 3—3 of FIG. 2.

The air flow into and out of the bellows is controlled by a valve V which is actuated by a solenoid S, which may be controlled by a timer T. During operation of the device, the valve V is normally in the position shown in FIG. 2, in which line pressure is applied to the bellows, causing it to expand so that the upper plate 30 thereof compresses the springs 24 until the top plate 30 of the bellows bears against the ends of the rods 22, and the bellows is charged with full line pressure.

To actuate the device to provide a burst of air into the hopper 12, the solenoid S of valve V is energized to cause the valve V to shift to the position shown in FIG. 4, closing the line L1 from the air supply and connecting the line L2 from the bellows to line L3 to the hopper wall opening.

The connection of line L2 to L3 allows the bellows to discharge a blast of air to the hopper. The rate of discharge of air is greatly increased by the force of the springs 24 urging the top plate 30 of the bellows downwardly, and the air in the bellows is almost completely discharged by the downward force of the springs.

In the particular embodiment of the invention illustrated, it has been found that with a line pressure of 100 pounds per square inch, and 3 springs 24 with a spring rate of 350 pounds per inch, when the valve V is shifted to the exhaust position, the bellows is substantially completely exhausted in 50 milliseconds, providing an air blast of high velocity.

Figure 5:
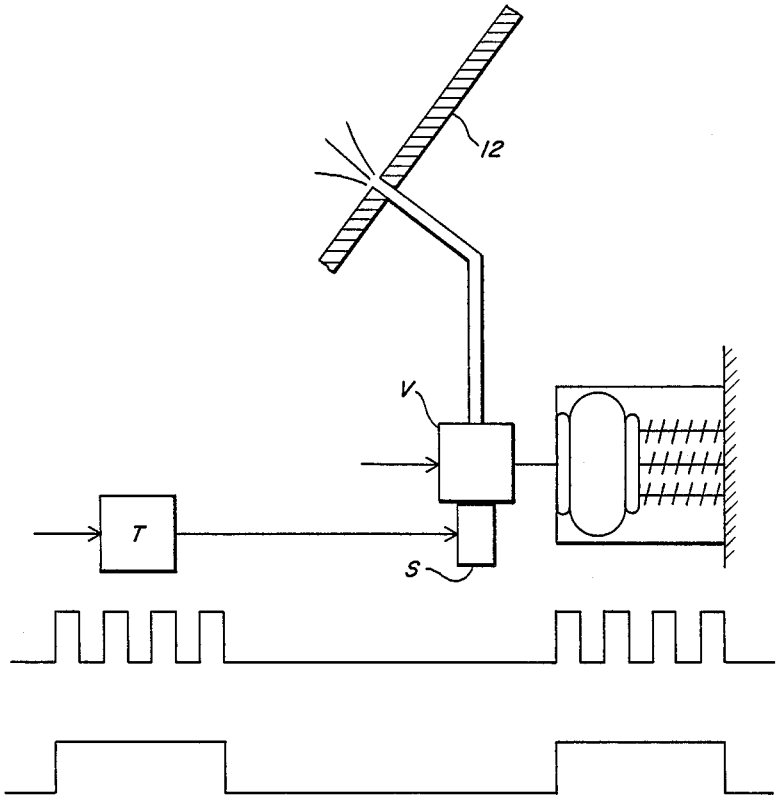
FIG. 5 is a schematic diagram of the air blast system.

As illustrated in FIG. 5, the solenoid S of the valve V may be actuated by a timer T, which may be adjusted to provide solenoid actuating pulses at desired intervals.

As illustrated, one function of the air blast generator disclosed herein is to eliminate "bridging" in particular material in feed hoppers. However the device may also be used to provide a strong air blast for other purposes, such as ejecting defective parts from a conveyor belt.

In a preferred construction of the device, the springs have a spring rate such that when the bellows is pressurized to full line pressure, the bellows is capable of compressing the springs the springs until the top plate 30 of the bellows bears against the ends of the rods 22. The rods 22, in addition to supporting the springs, also have their ends positioned to prevent excessive expansion of the bellows. By providing springs with the proper spring rate in relation to the line pressure to be used, so that when the bellows is charged with full line pressure the top plate 30 bears against the ends of the rods 22 with only a small force, the maximum amount of energy is stored in the springs with the minimum amount of air being required.

Although in the illustrated embodiment of the invention, springs 24 are provided for storing energy for rapidly exhausting the gas, it will be understood that other forms of energy storage may be utilized, such as a second bellows of a type similar to bellows 26, which said second bellows would be constantly pressurized to a pressure such that it would provide a spring rate similar to that of the springs 24.

Since certain obvious changes may be made in the herein illustrated embodiment of the invention without departing from the scope thereof, it is intended that all matter contained herein be interpreted in an illustrative and not a limiting sense.

I claim;

1. An air burst generator, comprising means for confining pressurized gas in a container, means for releasing said pressurized gas to a predetermined location, and means for rapidly mechanically reducing the volume of the container when substantially simultaneously with the actuation of said means for releasing the gas, whereby the gas is forced out of the container at a velocity much greater than the velocity with which the gas would leave the container without such volume reduction.

2. A device as set out in claim 1 in which said means for mechanically reducing the volume of the container is energized by the pressurization of the container.

3. An air burst generator, comprising a hollow member expansible by gas pressure applied to the interior thereof, spring means so associated with said member that said spring means is flexed to absorb energy when said member is expanded, stop means positioned to limit the amount of expansion of said member, and valve means for suddenly releasing the pressure from said hollow member, whereby the force of said flexed spring means against the hollow member causes rapid and complete exhaust of the gas from said hollow member.

4. An air burst generator as set out in claim 3 in which means is provided for directing said exhausted gas to a predetermined location.

5. An air burst generator, comprising a bellows having upper and lower plates which move apart when gas pressure is applied to the interior of the bellows, spring means positioned to be flexed to absorb energy by the movement of said plates away from each other, stop means associated with said plates to limit the distance said plates can move away from each other, and means for suddenly releasing the pressure from the interior of the bellows, whereby the spring means resile to release the energystored therein to thereby reduce the volume of the bellows to force substantially all of the gas from the bellows at a rate substantially greater than the rate would be if the energy stored in the spring means were not utilized.

6. An air burst generator as set out in claim 5 for use with an air supply of predetermined pressure in which the spring means has an effective spring rate and the stops are so positioned in relation to the bellows plates that when the bellows is pressurized to full air supply pressure, the bellows expands an amount such that the bellows plates bear against the stop members with a slight force.

7. In an air burst generator, comprising a housing, a bellows in said housing, said bellows having two end plate which move apart when the interior is pressureized, said bellows being mounted in the housing with one end plate being supported by one end of the housing and having an air inlet and an air outlet connected to the bellows, stop means in the housing positioned to limit the distance the other end plate can move away from the first end plate when the bellows expands due to air entering the air inlet, and spring means in the housing so associated with the bellows that expansion of the bellows causes said other end plate to compress the spring means to store energy until the bellows expansion is limited by said other plate abutting the stop means, and valve means connected to, when actuated, substantially simultaneously close the air inlet and open the air outlet, whereby when the valve is actuated pressure is released suddenly from the bellows and the spring resiles to expel substantially all of the gas from the bellows.

8. An air burst generator as set out in claim 7 in which said springs are so dimensioned in relation to the gas pressure to be fed to the bellows that when the bellows is charged to the full pressure, the said other end plate bears against the stop means with only a slight force.

9. In a system for storing and discharging particulate material, which comprises a hopper having sidewalls leading to a discharge chute which might be subject to bridging of the particulate material between the hopper walls above the discharge chute, the improvement comprising an aperture in a hopper wall above the discharge chute and means for supplying a series of short but powerful bursts of gas through the aperture into the hopper, said means comprising an air reservoir, valve means between the reservoir and the aperture, means for applying pressurized air to the reservoir, and mechanical means for rapidly reducing the volume of the reservoir when the valve means is opened between the reservoir and the aperture in the hopper wall, to thereby expel the gas substantially more rapidly than it would be expelled by the pressure of the gas alone.

10. A system as set out in claim 9 in which the means for rapidly reducing the volume of the reservoir is energized by the pressurization of the reservoir.

* * * * *